US010677551B2

(12) United States Patent
Drake

(10) Patent No.: US 10,677,551 B2
(45) **Date of Patent: *Jun. 9, 2020**

(54) BOLT ACTION CHASSIS FOR RIFLES, SHOTGUNS, AND MUZZLE LOADERS

(71) Applicant: Drake Associates, Inc., Vero Beach, FL (US)

(72) Inventor: Christopher C. Drake, Vero Beach, FL (US)

(73) Assignee: DRAKE ASSOCIATES, INC., Vero Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/196,121

(22) Filed: Nov. 20, 2018

(65) Prior Publication Data

US 2019/0093968 A1 Mar. 28, 2019

Related U.S. Application Data

(63) Continuation of application No. 15/407,847, filed on Jan. 17, 2017, now Pat. No. 10,132,583, which is a continuation-in-part of application No. 14/978,220, filed on Dec. 22, 2015, now Pat. No. 10,215,519.

(60) Provisional application No. 62/279,920, filed on Jan. 18, 2016, provisional application No. 62/095,233, filed on Dec. 22, 2014.

(51) Int. Cl.

| | |
|---|---|
| ***F41A 35/02*** | (2006.01) |
| ***F41A 11/02*** | (2006.01) |
| ***F41C 23/16*** | (2006.01) |
| ***F41C 7/00*** | (2006.01) |
| ***F41C 9/08*** | (2006.01) |
| ***F41A 35/06*** | (2006.01) |
| ***F41A 3/22*** | (2006.01) |
| ***F41A 3/66*** | (2006.01) |
| *F41C 23/14* | (2006.01) |

(52) U.S. Cl.

CPC ..... *F41A 11/02* (2013.01); *F41A 3/22* (2013.01); *F41A 3/66* (2013.01); *F41A 35/06* (2013.01); *F41C 7/00* (2013.01); *F41C 9/08* (2013.01); *F41C 23/16* (2013.01); *F41A 35/02* (2013.01); *F41C 23/14* (2013.01)

(58) Field of Classification Search

CPC .. F41A 35/02; F41A 35/06; F41A 3/66; F41A 5/18; F41C 23/16

USPC ..... 42/16, 25, 96, 70.11, 106

See application file for complete search history.

(56) References Cited

U.S. PATENT DOCUMENTS

| | | | | |
|---|---|---|---|---|
| 1,589,764 A * | 6/1926 | Rempt | F41A 3/22 | 42/18 |
| 2,940,201 A * | 6/1960 | Reed | F41A 35/02 | 42/16 |
| 3,341,963 A | 9/1967 | Seiderman | | |
| 3,619,926 A * | 11/1971 | Alday | F41A 35/02 | 42/16 |
| 3,791,060 A | 2/1974 | Weaver | | |

(Continued)

*Primary Examiner* — Michael D David

(74) *Attorney, Agent, or Firm* — Carter, Deluca & Farrell LLP

(57) ABSTRACT

A universal chassis for a firearm includes sidewalls. The sidewalls define a trigger well that is configured to receive a trigger mechanism. One of the sidewalls may define a cutout adjacent the trigger well. The chassis is configured to interchangeably receive a bolt action and a barrel for a shotgun, a muzzle loader, and a rifle. The cutout is sized and dimensioned to receive a lever arm of the bolt action.

14 Claims, 15 Drawing Sheets

(56) References Cited

U.S. PATENT DOCUMENTS

| | | | |
|---|---|---|---|
| 3,882,625 | A | 5/1975 | Tellie |
| 3,938,271 | A | 2/1976 | Hyytinen |
| 3,952,440 | A | 4/1976 | Tellie |
| 3,999,318 | A | 12/1976 | Tellie |
| 4,044,487 | A | 8/1977 | Hutton et al. |
| 4,562,659 | A | 1/1986 | Neta |
| 4,594,803 | A | 6/1986 | Muncy |
| 4,654,993 | A | 4/1987 | Atchisson |
| 4,691,615 | A | 9/1987 | Brunton |
| 4,896,447 | A | 1/1990 | Badoni |
| 5,669,252 | A | 9/1997 | Bentley |
| 5,918,401 | A | 7/1999 | Rowlands |
| 5,987,798 | A | 11/1999 | Ronkainen |
| 6,499,244 | B1 | 12/2002 | Smith et al. |
| 6,508,025 | B1 | 1/2003 | Du Plessis |
| 6,785,994 | B2 | 9/2004 | Christiansen |
| 7,395,626 | B2 | 7/2008 | Zedrosser |
| 7,596,900 | B2 | 10/2009 | Robinson et al. |
| 8,051,595 | B2 | 11/2011 | Hochstrate et al. |
| 8,393,103 | B2 | 3/2013 | Brown |
| 8,448,363 | B2 | 5/2013 | Fargnoli |
| 8,857,092 | B2 | 10/2014 | Bitsack |
| D729,337 | S | 5/2015 | Boone |
| 9,032,860 | B2 | 5/2015 | Faxon |
| 9,188,405 | B2 | 11/2015 | Hawley |
| 9,341,423 | B2 | 5/2016 | McGinty |
| 9,341,429 | B1 | 5/2016 | Reavis, III |
| 10,132,583 | B2 | 11/2018 | Drake |
| 2005/0016051 | A1 | 1/2005 | Fischbach |
| 2011/0056109 | A1 | 3/2011 | Farchione et al. |
| 2011/0232149 | A1 | 9/2011 | Fargnoli et al. |
| 2014/0224114 | A1 | 8/2014 | Faxon |
| 2015/0316339 | A1 | 11/2015 | Young |
| 2015/0323273 | A1 | 11/2015 | McGinty |
| 2016/0109203 | A1 | 4/2016 | Madia, II et al. |
| 2016/0178309 | A1 | 6/2016 | Drake |
| 2016/0202018 | A1 | 7/2016 | Bruhns |

* cited by examiner

BOLT ACTION CHASSIS FOR RIFLES, SHOTGUNS, AND MUZZLE LOADERS

CROSS-REFERENCE TO RELATED APPLICATIONS

This application is a continuation of U.S. patent application Ser. No. 15/407,847, filed Jan. 17, 2017, which is a continuation-in-part of U.S. patent application Ser. No. 14/978,220, filed Dec. 22, 2015, which claims priority to, and the benefit of, U.S. Provisional Application Ser. No. 62/095,233, filed Dec. 22, 2014. In addition, this application claims priority to, and the benefit of, U.S. Provisional Patent Application No. 62/279,920, filed Jan. 18, 2016. The entire contents of each of the above applications are hereby incorporated by reference.

BACKGROUND

1. Technical Field

The present disclosure relates to firearms and, more specifically, to a chassis for bolt action firearms.

2. Discussion of Related Art

Modular rifle systems allow manufacturers to produce standard components of a rifle that allow dealers and end users to customize the rifle system. The major components of a modular rifle system are a stock, a chassis, a barrel, and an action. The chassis is the central component of the modular rifle system and may be integrally formed with the stock. The barrel and action each mount to the chassis.

End users of modular rifle systems may be right or left-handed and require either a right or left-handed action.

SUMMARY

There is a need for a precision firearm chassis for use with shotgun and muzzle loader actions. Such a firearm chassis may accept a barrel and action for a variety of firearms such as a rifle, a shotgun, or a muzzle loader. The firearm chassis may be right-handed, left-handed, or ambidextrous.

In an aspect of the present disclosure, an ambidextrous chassis for a firearm includes sidewalls. The sidewalls define a trigger well that is configured to receive a trigger mechanism. Each of the sidewalls also defines a cutout adjacent the trigger well. Each of the cutouts is sized and dimensioned to receive a plug.

In aspects, the ambidextrous chassis includes a plug that is received within one of the cutouts of the sidewalls to seal the trigger well of the chassis. The chassis may include a forearm that defines a groove. The forearm may be configured to receive a barrel.

In some aspects, the sidewalls may define a magazine well that is configured to receive a magazine. The sidewalls may define a channel that is configured to receive an action. Each of the sidewalls may have an upper surface that is configured to be positioned below a centerline of an action that is received within the channel. Each of the cutouts of the sidewalls is configured to receive a lever arm of a bolt of an action.

In certain aspects, the plug includes an inner wall, an outer wall, and a central portion disposed between the inner and outer walls. The outer wall may be sized and dimensioned to form a contiguous outer surface with the one of the sidewalls. The plug may include a seal disposed about the central portion. The inner wall may include tabs that are configured to engage the one of the sidewalls to secure the plug within the cutout.

In another aspect of the present disclosure, a firearm includes a trigger mechanism, a plug, an ambidextrous chassis, a trigger mechanism, and a plug. The ambidextrous chassis includes sidewalls that define a trigger well. Each of the sidewalls define a cutout adjacent the trigger well. The trigger mechanism is positioned within the trigger well. The plug selectively positioned within one of the cutouts of the sidewalls to seal the trigger well of the chassis.

In aspects, the chassis includes a forearm that defines a groove. The firearm may include a barrel that is received within the groove. The sidewalls may define a magazine well. The firearm may include a magazine that is received within the magazine well. The sidewalls may define a channel. The firearm may include an action that is received within the channel. Each of the sidewalls may have an upper surface that is positioned below a centerline of the action when the action is received within the channel. The centerline of the action may be defined by a bolt of the action. The action may include a bolt that has a lever arm that is selectively received within the other one of the cutouts when the action is in a locked closed position.

In another aspect of the present disclosure, a method of assembling a firearm that has an ambidextrous chassis includes inserting a plug into a first cutout that is defined in a first sidewall of the chassis to seal a trigger well defined in the chassis and installing an action in a channel defined by the chassis such that a lever arm of a bolt to the action is selectively positionable within a second cutout defined in a second sidewall of the chassis opposing the first cutout to close the action.

In aspects, the method includes removing the plug from the first cutout such that the lever of the bolt is selectively positionable within the first cutout and inserting the plug in the second cutout to seal the trigger well.

In another aspect of the present disclosure, a chassis for a firearm includes sidewalls defining a trigger well that are configured to receive a trigger mechanism. One of the sidewalls defines a cutout that is adjacent the trigger well. The chassis is configured to interchangeably receive a bolt action and a barrel for at least one of a shotgun, a muzzle loader, and a rifle. The cutout is sized and dimensioned to receive a lever arm of the bolt action.

In aspects, the chassis is configured to receive a bolt action and barrel for a shotgun.

In some aspects, the chassis is configured to receive a bolt action and a barrel for a muzzle loader.

In particular aspects, the chassis is configured to receive a bolt action and a barrel for a rifle.

In certain aspects, the chassis is configured to interchangeably receive a bolt action and a barrel for at least two of a shotgun, a muzzle loader, and a rifle. The chassis may be configured to interchangeably receive a bolt action and a barrel for each of a shotgun, a muzzle loader, and a rifle.

In another aspect of the present disclosure, a firearm includes a bolt action, a barrel, a chassis and a trigger mechanism. The bolt action may be a shotgun bolt action, a rifle bolt action, or a muzzle loader bolt action. The bolt action may include a lever arm. The barrel may be a shotgun barrel, a rifle barrel, or a muzzle loader barrel. The chassis includes sidewalls that define a trigger well. At least one of the sidewalls defines a cutout that is adjacent the trigger well. The chassis is configured to interchangeably receive a bolt action and a barrel for a shotgun, a muzzle loader, and a rifle. The cutout is sized and dimensioned to receive the lever arm of the bolt action. The trigger mechanism may be positioned within the trigger well.

In another aspect of the present disclosure, a method of assembling a firearm that has a chassis includes installing a bolt of a shotgun action in a channel defined by the chassis such that a lever of the bolt is selectively positionable within a cutout defined in a sidewall of the chassis.

In another aspect of the present disclosure, a method of assembling a firearm that has a chassis includes installing a bolt of a muzzle loader action in a channel defined by the chassis such that a lever of the bolt is selectively positionable within a cutout defined in a sidewall of the chassis.

In another aspect of the present disclosure, a chassis for a fire arm includes sidewalls. The sidewalls define a trigger well that is configured to receive a trigger mechanism. At least one of the sidewalls define a cutout that is adjacent the trigger well. The cutout is sized and dimensioned to receive a lever arm of a shotgun bolt action.

In aspects, each of the sidewalls define a cutout adjacent the trigger well. Each cutout may be sized and dimensioned to receive a lever arm of a shotgun bolt action or a plug. The chassis may be ambidextrous, right-handed, or left-handed.

In another aspect of the present disclosure, a chassis for a fire arm includes sidewalls. The sidewalls define a trigger well that is configured to receive a trigger mechanism. At least one of the sidewalls define a cutout that is adjacent the trigger well. The cutout is sized and dimensioned to receive a lever arm of a muzzle loader bolt action.

In aspects, each of the sidewalls define a cutout adjacent the trigger well. Each cutout may be sized and dimensioned to receive a lever arm of a shotgun bolt action or a plug. The chassis may be ambidextrous, right-handed, or left-handed.

Further, to the extent consistent, any of the aspects described herein may be used in conjunction with any or all of the other aspects described herein.

One advantage of the ambidextrous chassis detailed herein is that the ambidextrous chassis may save valuable time in the field and significant costs in inventory by reducing the need for different weapon assemblies. In addition, the ambidextrous chassis may reduce the need for different weapon assemblies based on whether a shooter is right-handed or left-handed. Such improvements may increase weapon safety and allow a single chassis to be universally acceptable to whether a shooter is right-handed or left-handed.

Certain embodiments of the present disclosure may include some, all, or none of the above advantages. One or more other technical advantages may be readily apparent to those skilled in the art for the figures, descriptions, and claims included herein. Moreover, while specific advantages have been enumerated above, various embodiments may include all, some, or none of the enumerated advantages.

BRIEF DESCRIPTION OF THE DRAWINGS

Various aspects of the present disclosure are described hereinbelow with reference to the drawings, which are incorporated in and constitute a part of this specification, wherein.

DETAILED DESCRIPTION

Figure 1:
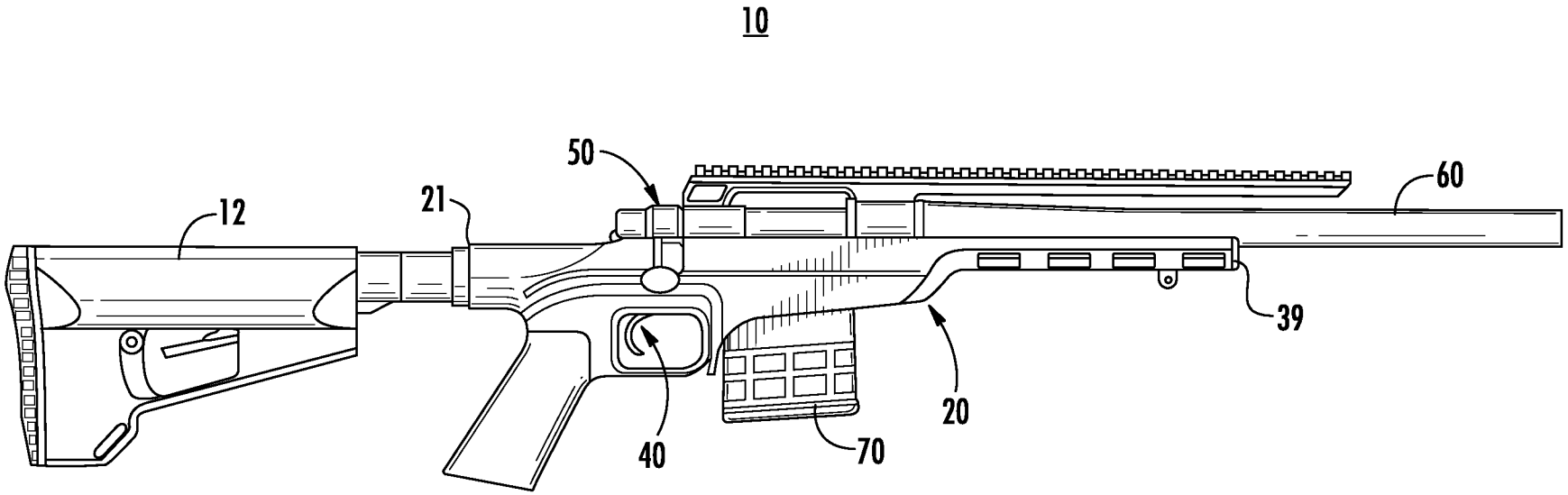
FIG. 1 is a side view of a modular rifle system having an ambidextrous chassis in accordance with the present disclosure.

Embodiments of the present disclosure are now described in detail with reference to the drawings in which like reference numerals designate identical or corresponding elements in each of the several views. Throughout this description, the term "proximal" refers to the portion of the device or component thereof that is closest to a user and the term "distal" refers to the portion of the device or component thereof that is farthest from the user.

As used herein the term "firearm" refers to a barreled weapon that launches one or more projectiles driven by an explosive force including, but not limited to, weapons colloquially referred to as rifles, shotguns, pistols, and muzzleloaders.

Detailed herein is a modular firearm system including a universal chassis for use with a bolt action. The chassis may be right-handed, left-handed, or ambidextrous. The chassis includes shallow sidewalls that are positioned below the centerline of the barrel and the action. The right and left sidewalls of the chassis may define cutouts adjacent the trigger well to allow the chassis to receive a lever arm of a right or left-handed action. The chassis may also include a plug for closing the cutout opposite the lever arm to prevent debris from entering the trigger mechanism of the modular firearm system.

Referring now to FIG. 1, a modular rifle system 10 is provided in accordance with the present disclosure and includes a stock 12, a chassis 20, a trigger mechanism 40, a rifle action 50, a rifle barrel 60, and a rifle magazine 70. The stock 12 attaches to a proximal end 21 of the chassis 20. It is contemplated that the stock 12 may be integrally formed with the chassis 20. As shown, the stock 12 is an adjustable stock; however, it is contemplated, that the stock 12 may be a fixed stock, a folding stock, or an adjustable folding stock.

Figure 2:
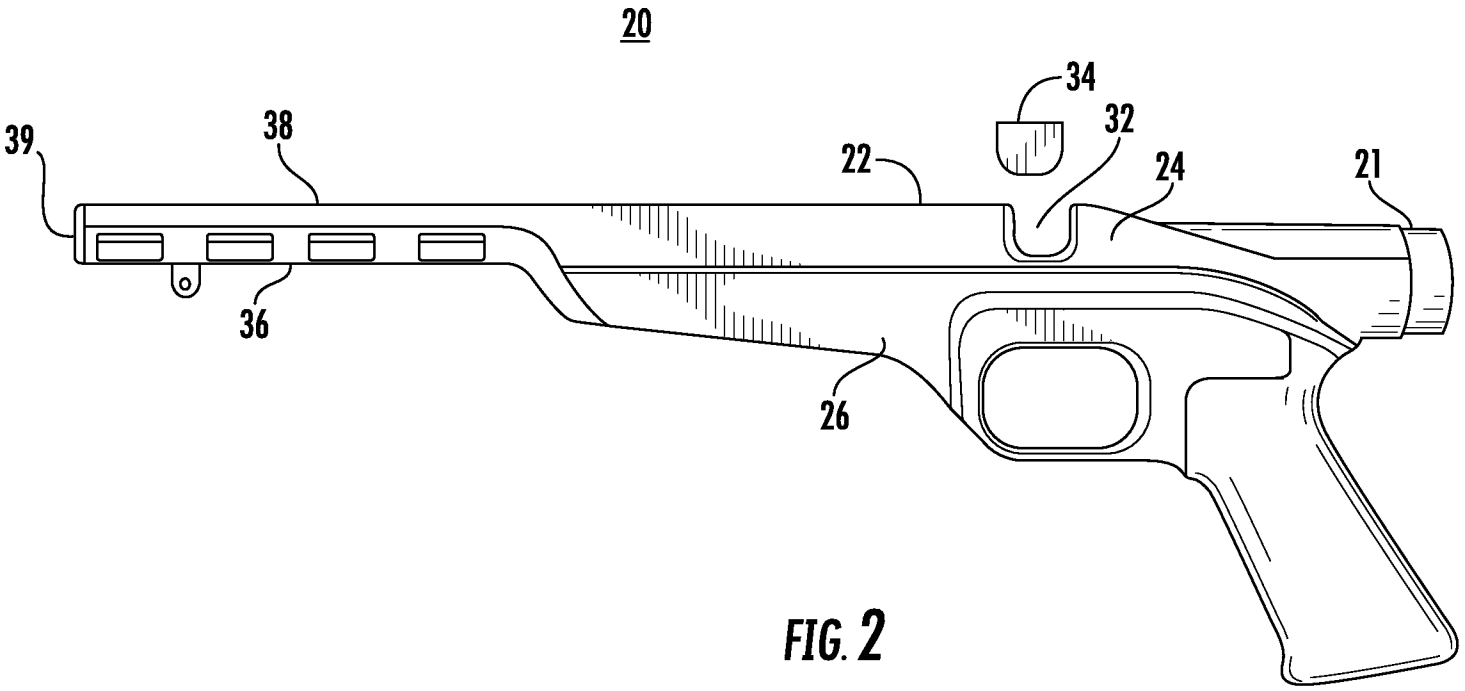
FIG. 2 is a side view of the chassis of FIG. 1.

With reference to FIG. 2, the chassis 20 includes sidewalls 22 that extend from the proximal end 21 to a forearm 36. The sidewalls 22 define a trigger well 24, and a magazine well 26. The forearm 36 extends from the magazine well 26 to a distal end 39 of the chassis 20. The trigger well 24 receives the trigger mechanism 40 and the magazine well 26 releasably receives the rifle magazine 70. The forearm 36 of the chassis 20 defines a groove 38 that receives the rifle barrel 60. It is envisioned that the magazine well 26 may be an internal magazine defined within the chassis 20.

Figure 3:
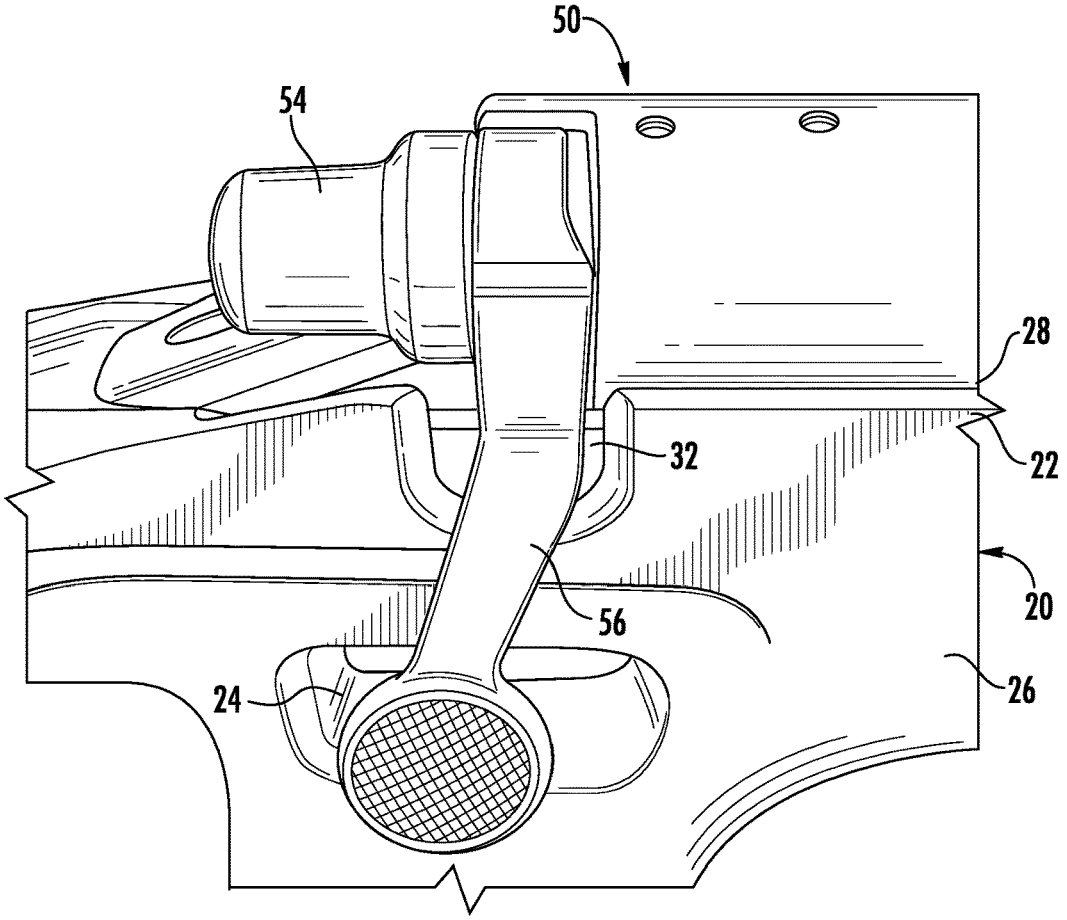
FIG. 3 is a perspective view of a distal portion of an action of the rifle of FIG. 1.
Figure 4:
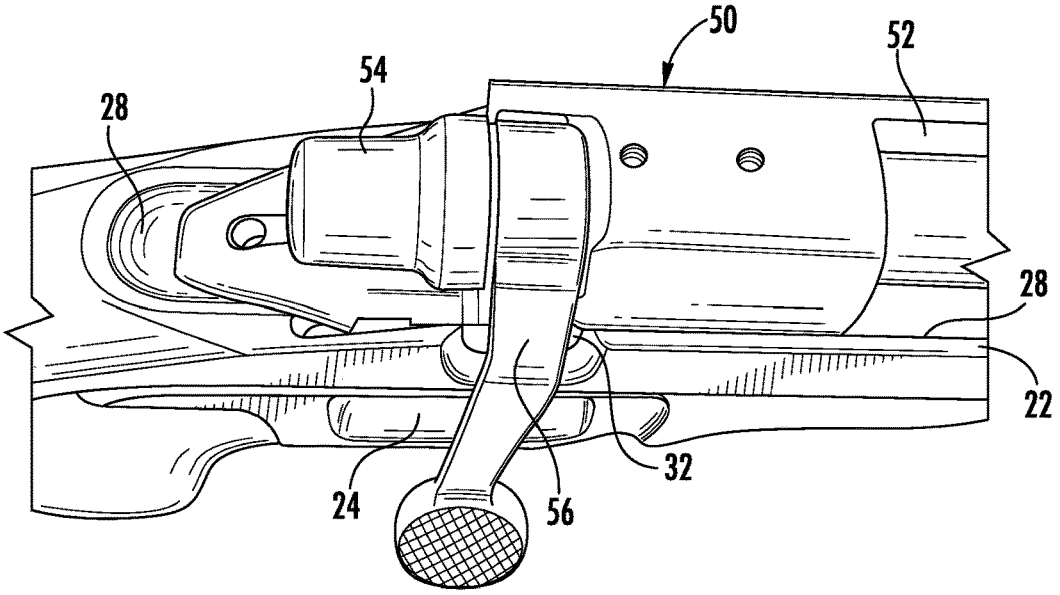
FIG. 4 is a top view of the distal portion of the action of FIG. 1.

Referring to FIGS. 3 and 4, the sidewalls 22 of the chassis 20 define a channel 28 above the trigger well 24 and the magazine well 26. The channel 28 receives the rifle action 50 which includes a bolt 54 and defines a chamber 52. The channel 28 is defined by sidewalls 22 of the chassis 20 and cradles about 135° of the bolt 54 such that upper surfaces of the sidewalls 22 are positioned below a centerline of the rifle action 50 and the bolt 54. The rifle action 50 and the bolt 54 are positioned substantially above sidewalls 22 of the chassis 20 such that the bolt 54 is freely slidable within the rifle action 50 and through the channel 28, as detailed below, and so that the rifle action 50 is accessible.

The bolt 54 is slidable and rotatable within rifle action 50 and through the channel 28 between a locked closed position (FIGS. 3 and 4), an unlocked closed position (not shown), and an open position (not shown). The bolt 54 includes a lever arm 56 that is engagable to rotate the bolt 54 between the locked closed position and the unlocked closed position and to slide the bolt 54 through the channel 28 between the unlocked closed position and the open position.

With reference to FIGS. 3 and 4, the sidewalls 22 of the chassis 20 define cutouts 32 above the trigger well 24 to provide clearance for the lever arm 56 of the bolt 54 and to rotate into the locked closed position. In the locked closed position, the chamber 52 is closed and the trigger mechanism 40 (FIG. 1) is actuatable to fire a cartridge (not shown) loaded in the chamber 52.

Figure 5:
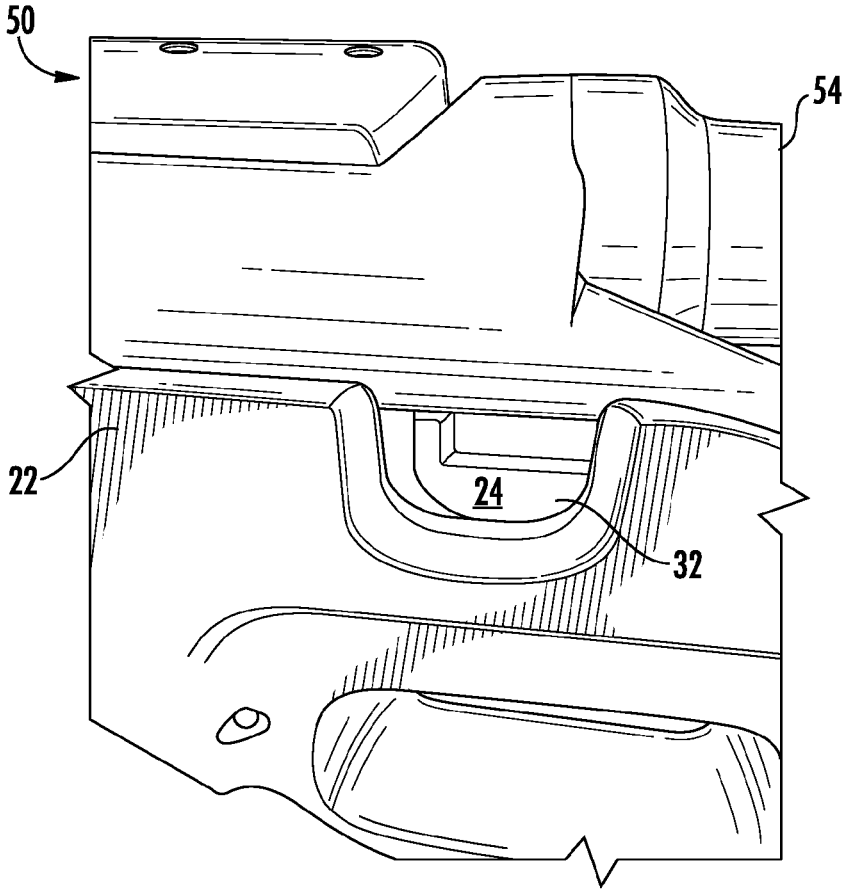
FIG. 5 is a left side view of the rifle of FIG. 1 with a plug removed from a cutout in a sidewall of the chassis.

The chassis 20 is ambidextrous to receive a right-handed or left-handed rifle action 50. The chassis 20 defines a cutout 32 in each sidewall 22 configured to receive the lever arm 56 of the bolt 54 and place it in the locked closed position. As shown, the rifle action 50 is a right-handed action allowing the lever arm 56 to rotate towards the right side of the modular rifle system 10 such that when the rifle action 50 is in the locked closed position, the cutout 32 in the right sidewall 22 of the chassis 20 receives the lever arm 56 of the bolt 54. With particular reference to FIG. 5, when a right-handed rifle action 50 is received by the chassis 20, the cutout 32 in the left sidewall 22 of the chassis 20 is open exposing the trigger well 24 of the chassis 20.

It will be appreciated that a left-handed rifle action 50 allows the lever arm 56 to rotate towards the left side of the modular rifle system 10 such that when the modular rifle system 10 is in the locked closed position, the cutout 32 in the left sidewall 22 of the chassis 20 receives the lever arm 56 of the bolt 54. Further, when a left-handed rifle action 50 is received by the chassis 20, the cutout 32 in the right sidewall 22 of the chassis 20 is open exposing the trigger well 24 of the chassis 20.

Figure 6:
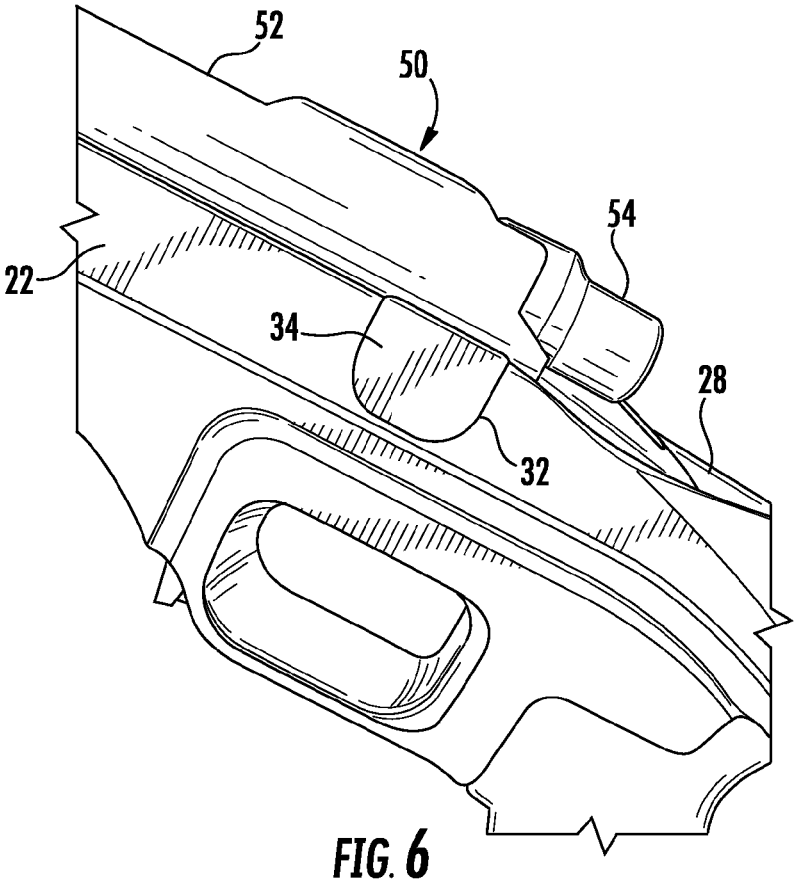
FIG. 6 is a left side view of the rifle of FIG. 1 with the plug in the cutout in the sidewall of the chassis.

Referring to FIG. 6, the chassis 20 includes a plug 34 that is receivable in the cutout 32 defined in the left or right sidewall 22 of the chassis 20. The plug 34 closes the cutout 32 of the sidewall 22 opposite the cutout 32 that receives the lever arm 56 of the bolt 54 when the bolt 54 is in the locked closed position. By closing the cutout 32, the plug 34 prevents debris (e.g., dirt, sand, grease, etc.) from entering the trigger well 24 of the chassis 20 and fouling the trigger mechanism 40. As detailed above, the chassis 20 is ambidextrous; however, it is envisioned that the chassis 20 may include a contiguous wall opposite the cutout 32 of the sidewall 22 that receives the lever arm 56 of the bolt 54 such that the chassis 20 is manufactured as a right-handed or left-handed chassis.

Figure 7:
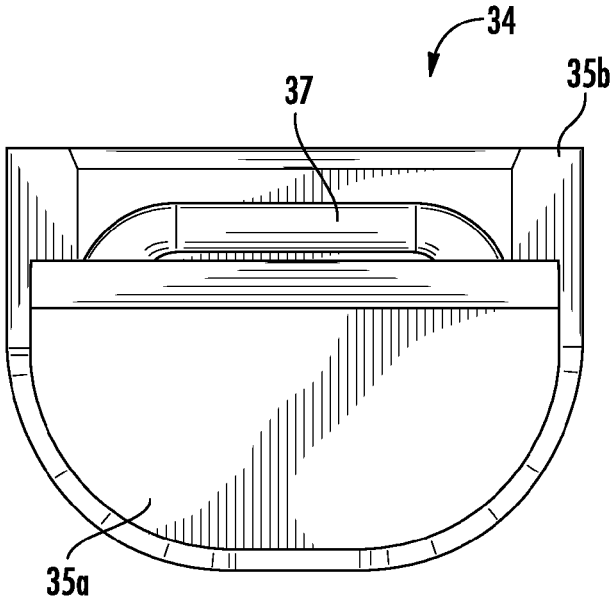
FIG. 7 is an inside view of the plug of FIG. 6.
Figure 8:
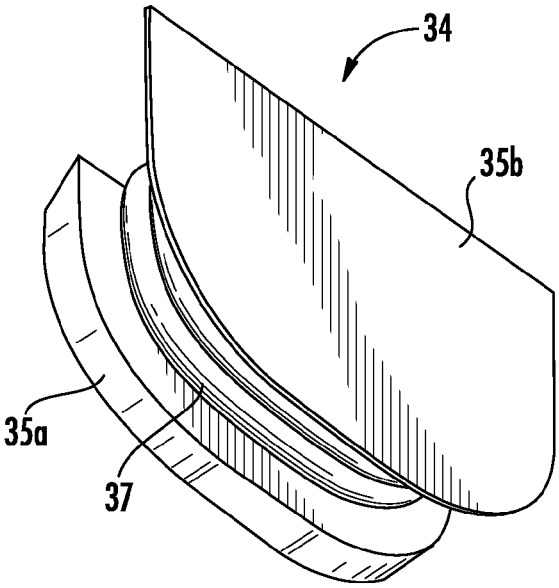
FIG. 8 is a lower perspective view of the plug of FIG. 6.
Figure 9:
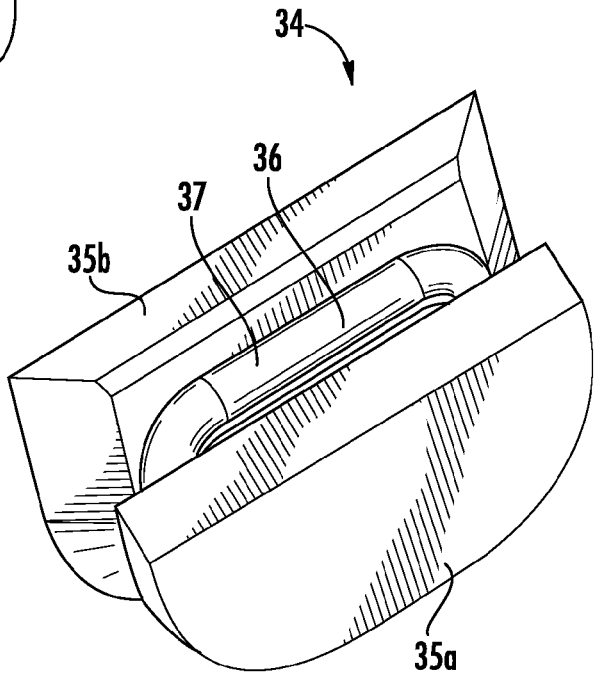
FIG. 9 is an upper perspective view of the plug of FIG. 6.

With reference to FIGS. 7-9, the plug 34 includes an inner wall 35*a*, an outer wall 35*b*, and a central portion 36 connecting the inner and outer walls 35*a*, 35*b*, and a seal 37. The central portion 36 of the plug 34 is sized to be received within the cutouts 32 in the sidewalls of the chassis 20. The outer wall 35*b* of the plug 34 is sized to form a contiguous surface with the sidewall 22 of the chassis 20 when the central portion 36 is received within one of the cutouts 32. The inner wall 35*a* of the plug 34 is larger than the central portion 36 to secure the plug 34 within the cutout 32. An upper surface of the inner wall 35*a* of the plug 34 is positioned below an upper surface of the outer wall 35*b* of the plug 34. The inner wall 35*a* and the outer wall 35*b* frictionally engage the sidewall 22 of the chassis 20 to retain the plug 34 within the cutout 32. The seal 37 is disposed over the central portion 36 to frictionally engage the sidewall 22 of the chassis 20 to retain the plug 34 within the cutout 32.

Figure 10:
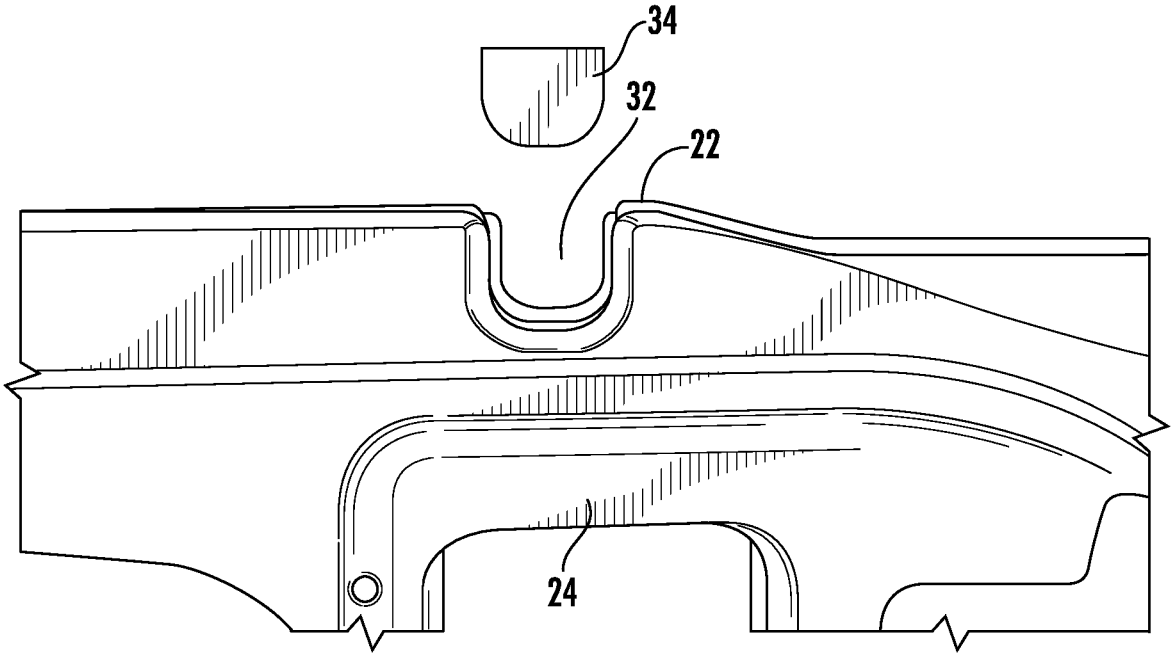
FIG. 10 is a side view of the chassis of FIG. 2 and the plug of FIG. 6 positioned over a cutout in the sidewall of the chassis.
Figure 11:
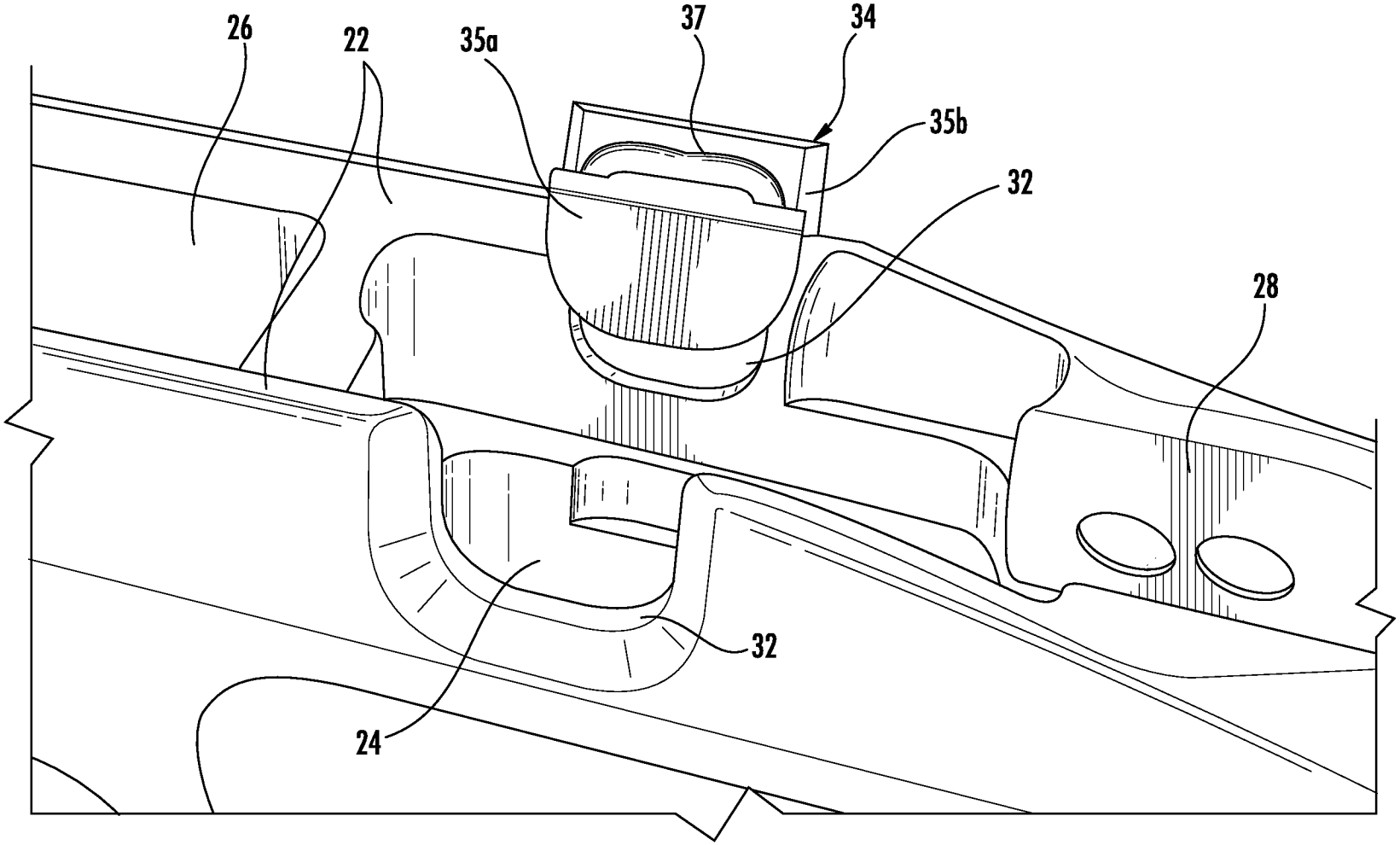
FIG. 11 is a left side view of the plug of FIG. 10 partially seated in the right cutout of chassis.
Figure 12:
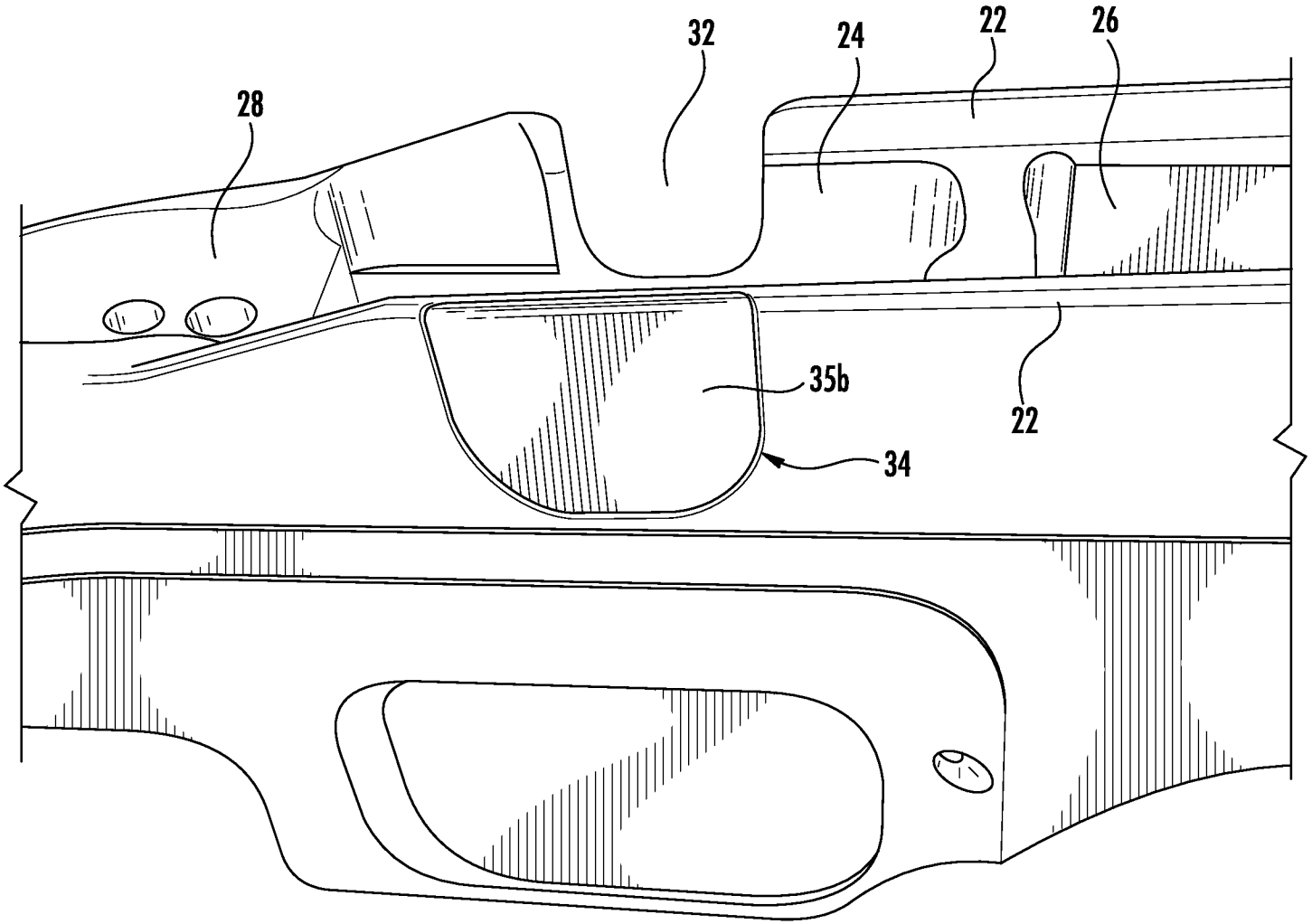
FIG. 12 is a right side view of the chassis of FIG. 11 with the plug fully seated in the right cutout of the chassis.
Figure 13:
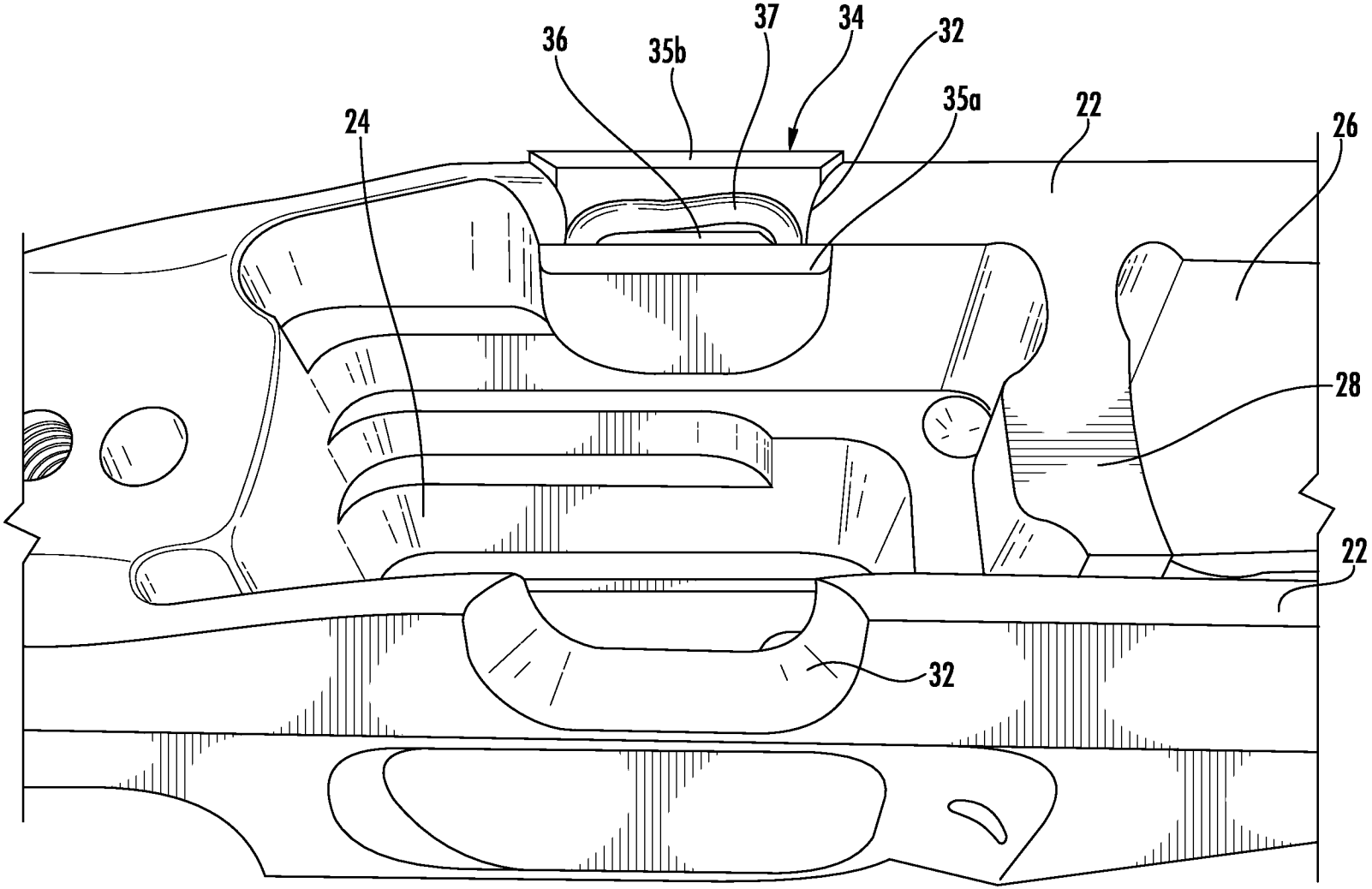
FIG. 13 is a right perspective view of the chassis of FIG. 2 with the plug fully seated in the left cutout of the chassis.
Figure 16:
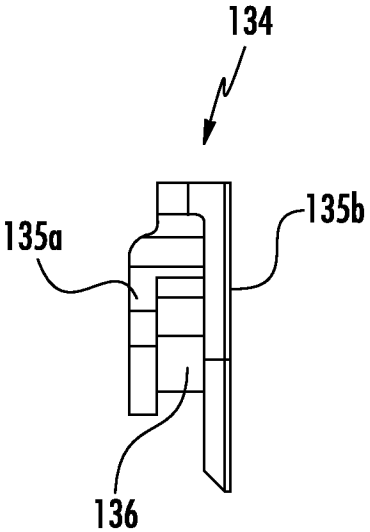
FIG. 16 is a side view of the plug of FIG. 14.
Figure 15:
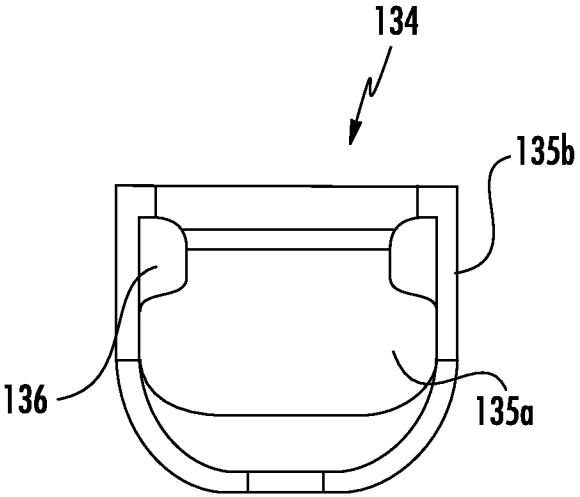
FIG. 15 is an inside view of the plug of FIG. 14.
Figure 18:
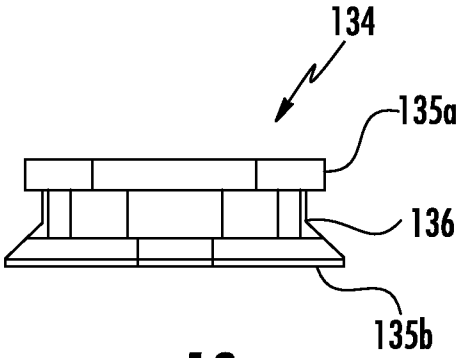
FIG. 18 is a bottom view of the plug of FIG. 14.
Figure 14:
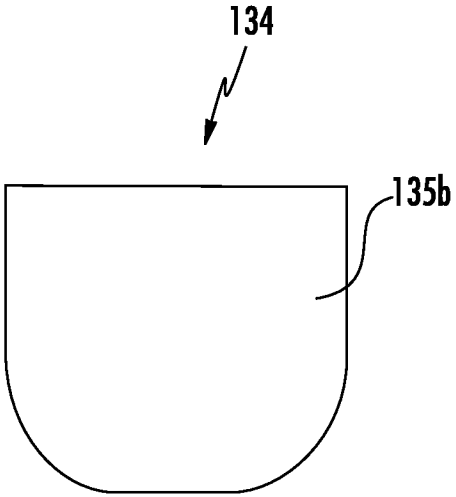
FIG. 14 is an outside view of another plug provided in accordance with the present disclosure.
Figure 17:
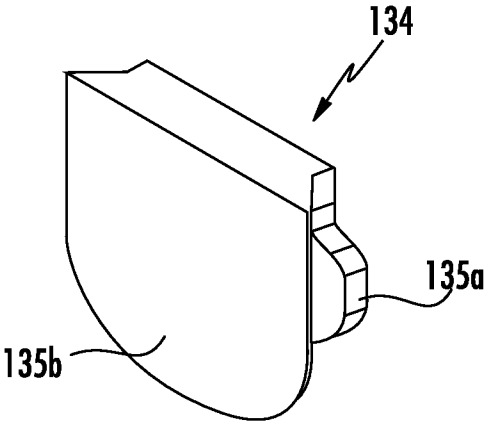
FIG. 17 is a perspective view of the plug of FIG. 14.
Figure 19:
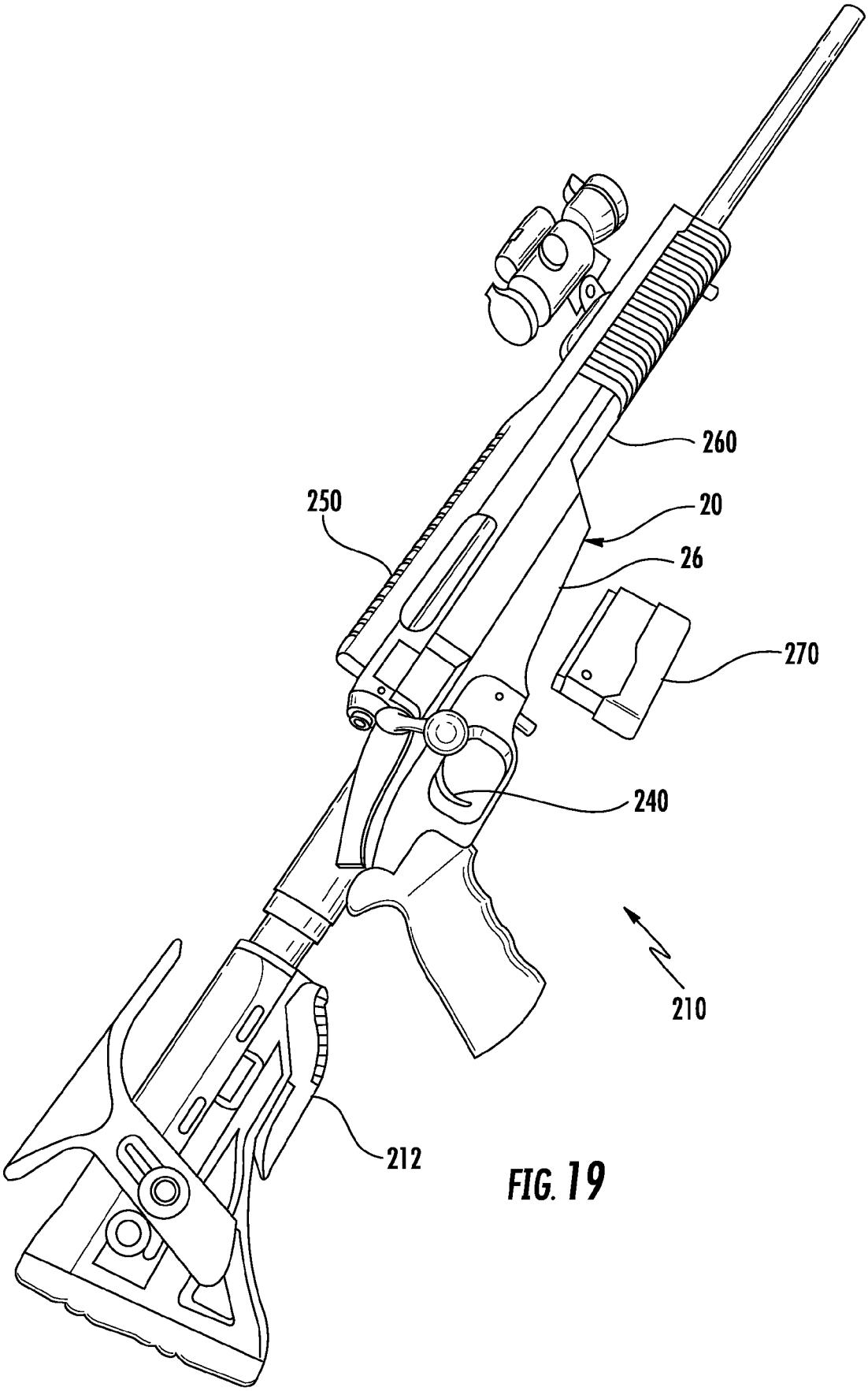
FIG. 19 is a perspective view of a modular shotgun system having an ambidextrous chassis in accordance with the present disclosure.
Figure 20:
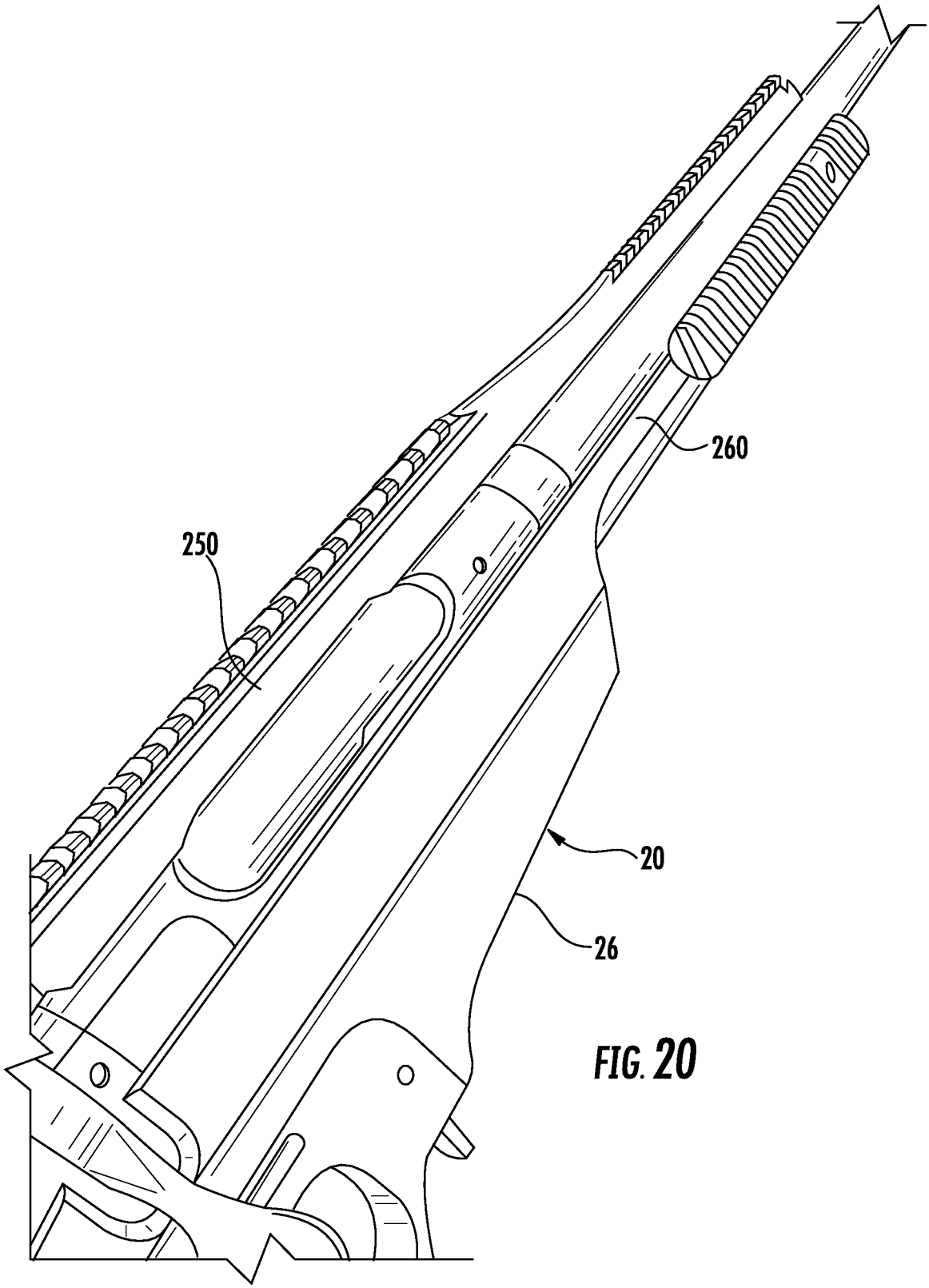
FIG. 20 is an enlarged perspective view of a shotgun bolt action of the modular shotgun system of FIG. 19.
Figure 21:
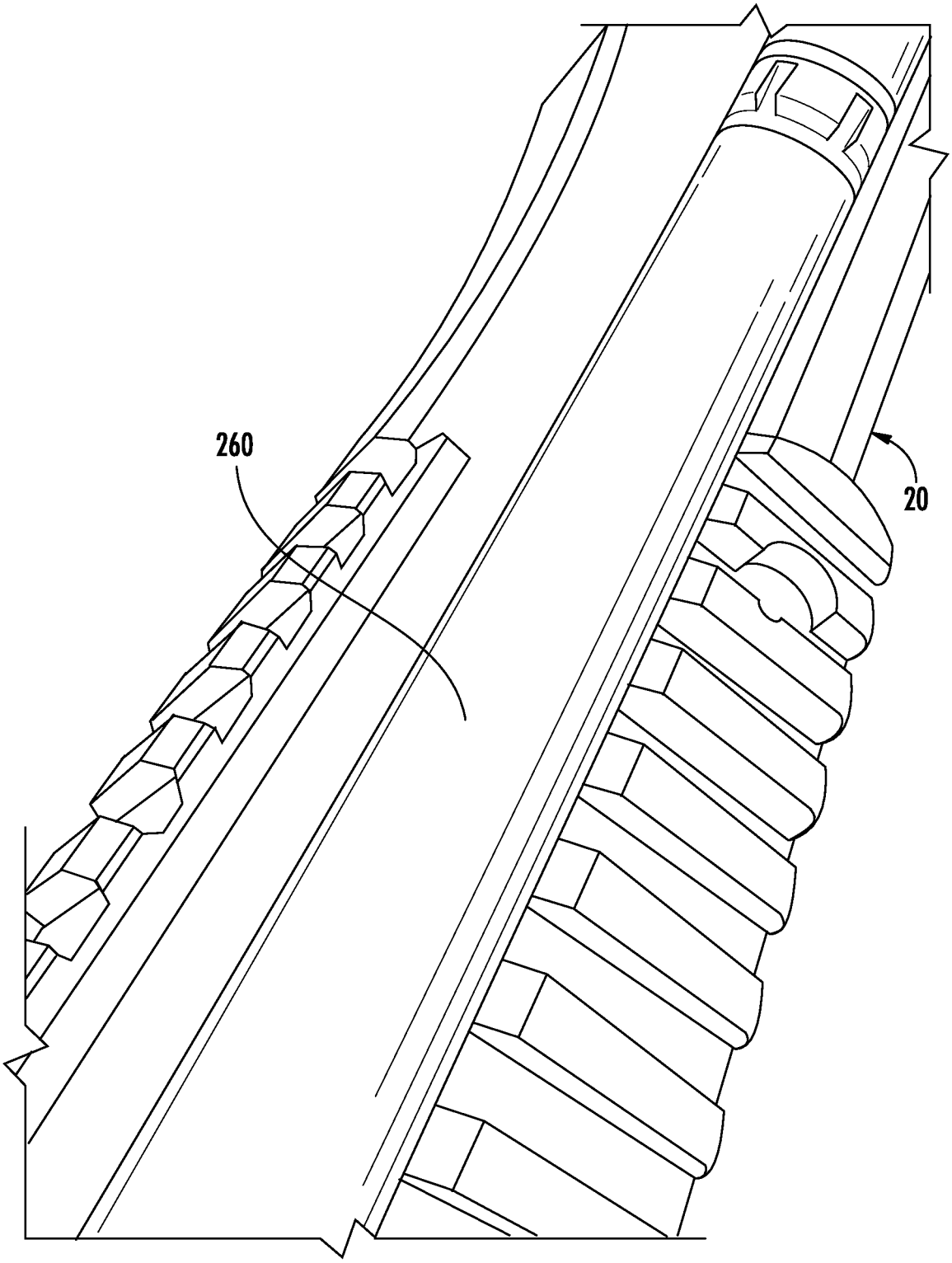
FIG. 21 is an enlarged perspective view of a shotgun barrel of the modular shotgun system of FIG. 19.
Figure 22:
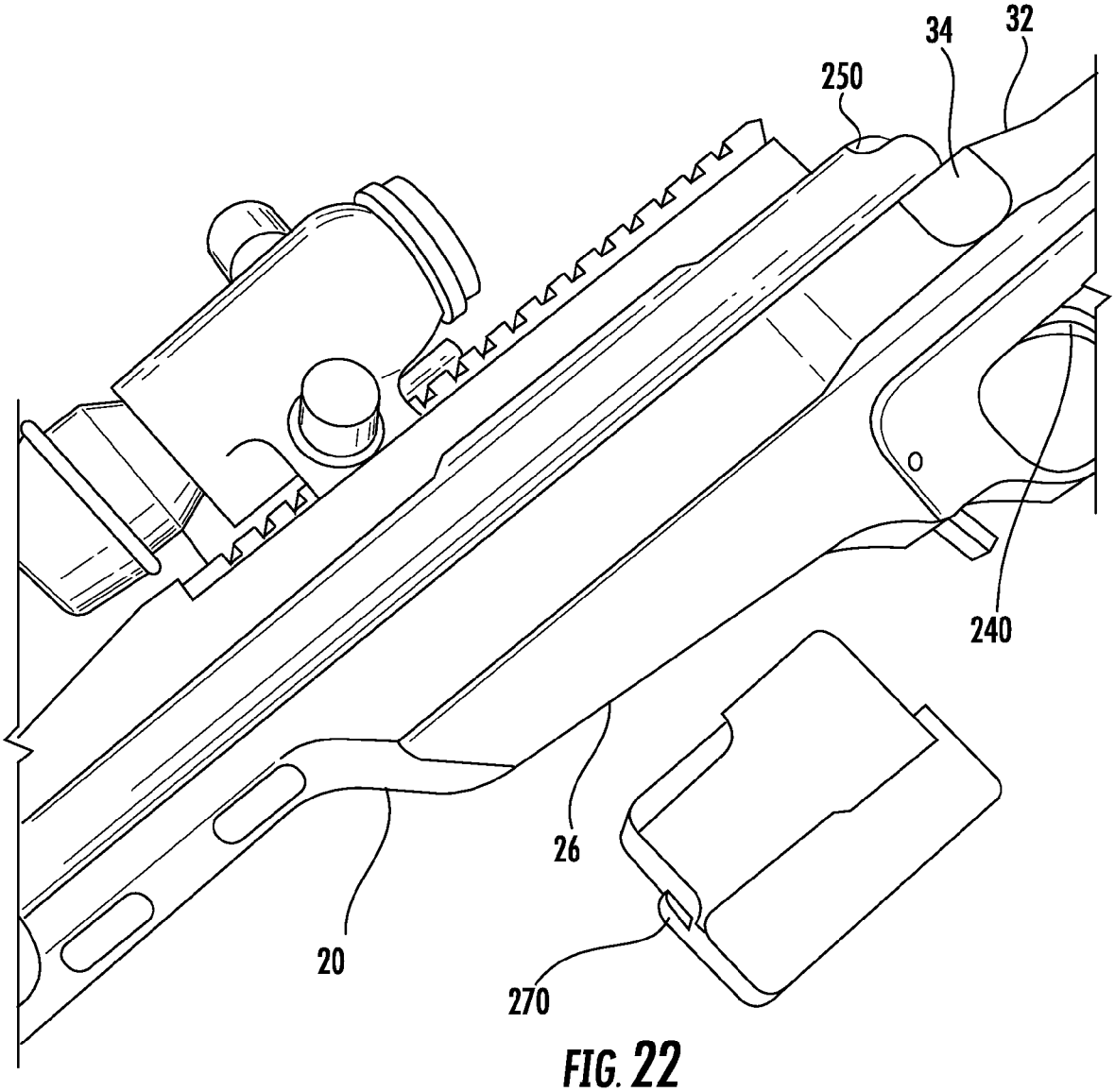
FIG. 22 is a perspective view of the modular shotgun system of FIG. 19 with the magazine removed.
Figure 23:
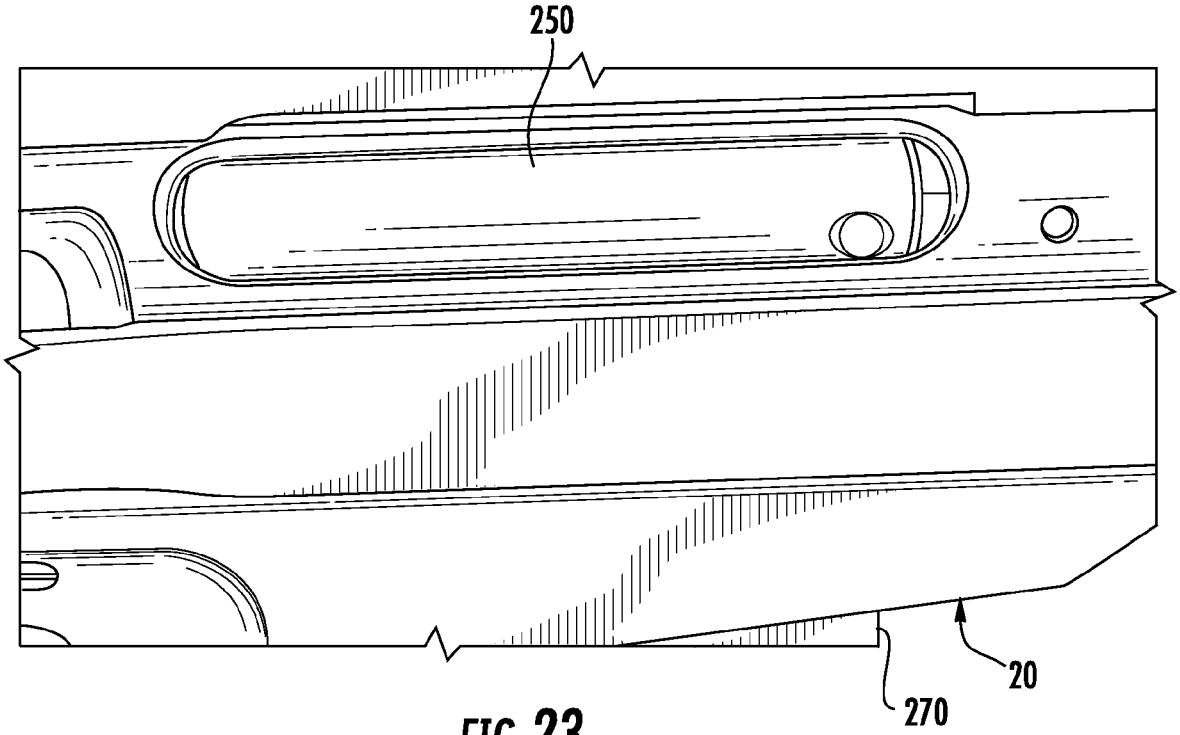
FIG. 23 is a side view of the shotgun bolt action of FIG. 20.

Referring now to FIGS. 10-12, the plug 34 is seated into the cutout 32 in the right sidewall 22 of the chassis 20. First, the plug 34 is aligned with the cutout 32 such that the inner wall 35*b* of the plug 34 is positioned on an inner surface of the sidewall 22. The plug 34 is then slid into the cutout 32 until an upper surface of the outer wall 35*a* is aligned with an upper surface of the sidewall 22 as shown in FIG. 10. When the plug 34 is seated within the cutout 32, the outer wall 35*b* forms a contiguous surface with the sidewall 22. As shown in FIG. 13, the plug 24 may also be received in the cutout 32 in the left sidewall 22 of the chassis 20.

The movement of the bolt 54 from the locked closed position, to the unlocked closed position, and to the open position is detailed herein for a right-handed rifle action 50. In the locked closed position, the lever arm 56 is positioned in the cutout 32 defined in the right sidewall 22 of the chassis 20 as shown in FIG. 3. To move the bolt 54 to the unlocked closed position, the lever arm 56 is rotated counter-clockwise as indicated by arrow CCW to rotate the bolt 54 about its longitudinal axis. The lever arm 56 is rotated from its locked closed position to its unlocked closed position. In the unlocked closed position, the lever arm 56 is pulled proximally to slide the bolt 54 through the channel 28 towards the open position. As the bolt 54 slides to the open position, a cartridge (not shown) is ejected from the chamber 52. In the right-handed configuration, the cartridge is ejected from the right side of the chamber 52. As the bolt 54 reaches the open position, a lower portion of the chamber 54 is opened to allow a new cartridge from the rifle magazine 70 to enter the chamber 52. Alternatively, a new cartridge may be placed directly into the chamber 52 when the bolt 54 is in the open position.

When a new cartridge is within the chamber 52, the lever arm 56 is engaged to slide the bolt 54 distally towards the unlocked closed position. As the bolt 54 slides distally within the channel 28, the new cartridge is positioned or loaded into the chamber 52. When the bolt 54 reaches the unlocked closed position, the lever arm 56 is rotated clockwise into the cutout 32 and into the locked closed position to rotate the bolt 54 about its longitudinal axis.

It will be appreciated that when the modular rifle system 10 includes a left-handed rifle action 50, the rifle action 50 functions in a substantially similar manner with the rotation of the lever arm 56 reversed. That is, the lever arm 56 is rotated in the clockwise direction to unlock the bolt 54 and rotated in the counter-clockwise direction to lock the bolt 54. Further, spent cartridges are ejected from the left side of the chamber instead of from the right side of the chamber when the modular rifle system 10 includes a left-handed rifle action 50.

Referring to FIGS. 14-18, another plug 134 is provided in accordance with the present disclosure. The plug 134 is substantially similar to the plug 34 detailed above, as such only the differences will be detailed herein.

The plug 134 includes an inner wall 135*a*, an outer wall 135*b*, and a central portion 136 connecting the inner and outer walls 135*a*, 135*b*. The central portion 136 is contiguous with an upper surface of the inner and outer walls 135*a*, 135*b* such that the upper surface of the plug 134 may form a contiguous upper surface with an upper surface of the sidewalls 22 of the chassis 20 when the plug 134 is received within one of the cutouts 32. The inner wall 135*a* defines cutouts 137 near an upper surface of the central portion 136 with form tabs 139 of the inner wall. The tabs 139 may engage the sidewall 22 of the chassis 20 to secure the plug 134 within the cutout 32 of the chassis 20.

It is contemplated that a chassis (e.g., chassis 20) and plug (e.g., plug 34 or 134) may be constructed from the same material or made from different materials. Contemplated materials for chassis and plugs include, but are not limited to, natural materials (e.g., wood), man-made materials (e.g.,) Kevlar®, composite materials (e.g., carbon fiber), metals, metal alloys, synthetic materials, laminated materials, compressed woven materials, and any combination thereof.

As detailed herein, the cutouts 32 and the plugs 34, 134 are substantially rectangular in shape; however, it is contemplated that the cutouts 32 and the plugs 34, 134 may have differing shapes, including but not limited to, semi-circular and elliptical to provide clearance for the lever arm 56 of the bolt 54 in the locked closed position.

Referring now to FIGS. 19-23, a modular shotgun system 210 is provided in accordance with the present disclosure and includes the chassis 20, a stock 212, a trigger mechanism 240, a shotgun action 250, a shotgun barrel 260, and a shotgun magazine 270. The modular shotgun system 210 is a precision bolt action shotgun which may be used when rifles are inappropriate and/or illegal. As shown, the chassis 20 can interchangeably receive the shotgun action 250 and shotgun barrel 260 for the rifle action 50 and rifle barrel 60. It is envisioned that the chassis 20 can be unaltered or slightly modified to accommodate the shotgun action 250 and the shotgun barrel 260. For example, the magazine well 26 of the chassis 20 may enlarged to receive the shotgun magazine 270 instead of the rifle magazine 70.

In addition, it is envisioned that a chassis similar to the ambidextrous chassis 20 could be manufactured with a contiguous sidewall opposite the sidewall that defines a cutout 32 to receive a lever arm of the action such that the chassis is right-handed or left-handed. Further, the ambidextrous chassis 20 may include a plug (e.g., plug 34 or plug 134) that is permanently installed in a cutout 32 to prevent the ambidextrous chassis 20 from being switched between right-handed and left-handed operation.

As detailed above, the ambidextrous chassis 20 is used with the modular rifle system 10 and the modular shotgun system 210. It is also envisioned that the ambidextrous chassis 20 can be used with modular muzzle loader systems. It is envisioned that the same ambidextrous chassis 20 may be interchangeably used for each of a modular rifle system, a modular shotgun system, and a modular muzzle loader system. In addition, it is envisioned that a chassis similar to the ambidextrous chassis 20 could be manufactured with a contiguous sidewall opposite the sidewall that defines a cutout 32 to receive a lever arm of the action such that the chassis is right-handed or left-handed. Further, the ambidextrous chassis 20 may include a plug (e.g., plug 34 or plug 134) that is permanently installed in a cutout 32 to prevent the ambidextrous chassis 20 from being switched between right-handed and left-handed operation.

While several embodiments of the disclosure have been shown in the drawings, it is not intended that the disclosure be limited thereto, as it is intended that the disclosure be as broad in scope as the art will allow and that the specification be read likewise. Any combination of the above embodiments is also envisioned and is within the scope of the appended claims. Therefore, the above description should not be construed as limiting, but merely as exemplifications of particular embodiments. Those skilled in the art will envision other modifications within the scope of the claims appended hereto.

What is claimed:

1. A chassis for a firearm, the chassis comprising:

sidewalls defining a trigger well configured to receive a trigger mechanism, each sidewall including a cutout defined adjacent the trigger well in opposition to one another, the chassis configured to interchangeably receive an action and a barrel, each cutout sized and dimensioned to receive a lever arm of the action, one of the cutouts configured to receive a plug and the other one of the cutouts configured to receive the lever arm of the action, the plug being configured and dimensioned for sealing the respective sidewall such that the plug forms a smooth surface with an outer surface of the respective sidewall, wherein the plug includes an inner wall, an outer wall, and a central portion interconnecting the inner and outer walls, the central portion sized and dimensioned to fit within the cutout, the outer wall having a length and height greater than the central portion, the inner wall having a length and a width greater than the central portion.

2. The chassis according to claim 1, wherein the chassis is configured to receive a bolt action and barrel for a shotgun.

3. The chassis according to claim 1, wherein the chassis is configured to receive a bolt action and barrel for a muzzle loader.

4. The chassis according to claim 1, wherein the chassis is configured to receive a bolt action and barrel for a rifle.

5. The chassis according to claim 1, wherein the chassis is configured to interchangeably receive a bolt action and a barrel for at least two of a shotgun, a muzzle loader, or a rifle.

6. The chassis according to claim 1, wherein the chassis is configured to interchangeably receive a bolt action and a barrel for each of a shotgun, a muzzle loader, and a rifle.

7. The chassis according to claim 1, wherein the plug is received in a cutout on a left side of the chassis such that the chassis is right-handed.

8. The chassis according to claim 1, wherein the plug is received in a cutout on a right side of the chassis such that the chassis is left-handed.

9. The chassis according to claim 1, wherein the plug includes a seal disposed about the central portion, the seal configured to frictionally engage the sidewall to retain the plug within the cutout.

10. A firearm comprising:

an action;

a barrel;

a chassis including sidewalls defining a trigger well configured to receive a trigger mechanism, each sidewall including a cutout defined adjacent the trigger well in opposition to one another, each cutout sized and dimensioned to receive a lever arm of the action;

a trigger mechanism positioned within the trigger well; and a plug configured to be received in one of the cutouts and the other one of the cutouts configured to receive the lever arm of the action, the plug sealing the respective sidewall such that the plug forms a smooth surface with an outer surface of the respective sidewall, wherein the plug includes an inner wall, an outer wall, and a central portion interconnecting the inner and outer walls, the central portion sized and dimensioned to fit within the cutout, the outer wall having a length and height greater than the central portion, the inner wall having a length and a width greater than the central portion.

11. The firearm according to claim 10, wherein the action is a shotgun bolt action.

12. The firearm according to claim 10, wherein the action is a rifle bolt action.

13. The firearm according to claim 10, wherein the action is a muzzle loader bolt action.

14. The firearm according to claim 10, wherein the plug includes a seal disposed about the central portion, the seal configured to frictionally engage the sidewall to retain the plug within the cutout.

* * * * *